US005856075A

United States Patent [19]

Jeffries et al.

[11] Patent Number: 5,856,075

[45] Date of Patent: Jan. 5, 1999

[54] RADIOGRAPHIC ELEMENTS THAT EXHIBIT REDUCED GLOSS NON-UNIFORMITIES WHEN QUICK PROCESSED

[75] Inventors: Patrick M. Jeffries, Pittsford; Frank W. Keene, Jr., Fairport, both of N.Y.

[73] Assignee: Eastman Kodak Company, Rochester, N.Y.

[21] Appl. No.: 915,810

[22] Filed: Aug. 21, 1997

[51] Int. Cl.[6] ..... G03C 1/035; G03C 1/46

[52] U.S. Cl. ..... 430/502; 430/567; 430/950; 430/963; 430/966

[58] Field of Search ..... 430/502, 567, 430/950, 963, 966

[56] References Cited

U.S. PATENT DOCUMENTS 4,585,729 4/1986 Susimoto et al. ..... 430/502

5,028,520 7/1991 Ito ..... 430/567

5,041,364 8/1991 Dickerson et al. ..... 430/502

FOREIGN PATENT DOCUMENTS 61-201235 9/1986 Japan .

*Primary Examiner*—John A. McPherson

*Attorney, Agent, or Firm*—Carl O. Thomas

[57] ABSTRACT

Medical diagnostic radiographic elements capable of being processed in less than 45 seconds are disclosed that exhibit reduced gloss non-uniformities, Gloss non-uniformity reduction is attributable to the presence of a hydrophilic colloid layer overlying the imaging layer unit containing radiation-sensitive nontabular silver halide grains accounting for from 0.5 to less than 10 percent of monolayer coverage and having a mean equivalent circular diameter ranging from greater than the thickness of the overlying hydrophilic colloid layer up to 1.6 times the thickness of the overlying hydrophilic colloid layer.

8 Claims, No Drawings

RADIOGRAPHIC ELEMENTS THAT EXHIBIT REDUCED GLOSS NON-UNIFORMITIES WHEN QUICK PROCESSED

FIELD OF THE INVENTION

The invention is directed to medical diagnostic radiographic elements. More specifically, the invention pertains to radiographic elements containing silver halide emulsions for imaging that are intended for rapid access processing.

DEFINITION OF TERMS

The term "medical diagnostic radiographic element" is employed to designate an element capable of producing an image useful in forming a medical diagnosis. The element can be one that forms an image upon imagewise direct or indirect exposure to X-radiation or one that is digitally exposed to recreate an image pattern of X-radiation exposure.

In referring to grains and emulsions containing two or more halides, the halides are named in order of ascending concentrations.

The term "high bromide" in referring to grains and emulsions indicates that bromide is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabularity" designates $ECD \div t^2$, where ECD and t are both measured in $\mu$m.

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The terms "front" and "back" in referring to radiographic imaging are used to designate locations nearer to and farther from, respectively, the source of X-radiation than the support of the radiographic element.

The term "dual-coated" is used to indicate a radiographic element having emulsion layers coated on both the front and back sides of its support.

The "thickness" of the overlying hydrophilic colloid layer containing nontabular grains is its thickness measured at sites where protruding particles (e.g., nontabular grains or matte beads) are absent.

The term "overall processing" refers to processing that occurs between the time an image-wise exposed element is introduced into a processor and the time the element emerges dry. The processing steps include development, fixing, washing and drying.

The term "rapid access processing" refers to overall processing in less than 90 seconds.

The term "quick processing" refers to overall processing in less than 45 seconds.

The term "fully forehardened" means that the hydrophilic colloid layers are forehardened in an amount sufficient to reduce swelling of these layers to less than 300 percent, percent swelling being determined by (a) incubating the radiographic element at 38° C. for 3 days at 50 percent relative humidity, (b) measuring layer thickness, (c) immersing the radiographic element in distilled water at 21° C. for 3 minutes, and (d) determining the percent change in layer thickness as compared to the layer thickness measured in step (b).

*Research Disclosure* is published by Kenneth Mason Publications, Ltd., Dudley House, 12 North St., Emsworth, Hampshire P010 7DQ, England.

BACKGROUND

In arriving at a diagnosis a medical radiologist typically relies to a large extent, often entirely, on a visual study of silver images in radiographic films. Image inspection usually occurs with the film mounted on a light box, a white, translucent illumination source. To facilitate an accurate diagnosis a number of varied images are usually mounted and studied together.

Factors in addition to the characteristic curve parameters, such as minimum and maximum densities and contrasts in different curve regions, that significantly influence radiographic film selection by a radiologist include the following:

First, the radiographic element must be capable of producing images with minimal distracting artifacts. Artifacts include non-uniformities that run the risk of being mistaken for image features, produce visual fatigue, or are aesthetically distracting or displeasing, even when they have no proven impact on diagnosis.

Second, the radiographic element must be capable of rapid (less than 90 seconds overall) processing and, to an increasing extent, quick (less than 45 seconds overall) processing. Historically, a rapid processing capability has been acceptable, but to an increasing extent radiologists are requiring a quick processing capability.

Dickerson and Childers U.S. Pat. No. 5,041,364 disclose an approach for reducing surface glare in a medical diagnostic radiographic film (and thus visual fatigue). This is accomplished by overcoating an image forming layer unit including a silver halide emulsion layer coated on a support with an overlying layer unit containing a tabular grain silver halide emulsion. The tabular grains have a mean ECD of greater than 1.5 $\mu$m and a tabularity of greater than 25.

PROBLEM TO BE SOLVED

It has been observed that, when radiographic elements containing one or more tabular grain emulsions have received quick overall processing, there are non-uniformities in surface gloss in areas of maximum density. The non-uniformities are quite plainly visible when a film is given a uniform maximum density exposure and then run through a quick processing cycle.

This is an entirely different phenomenon than the high surface glare addressed by Dickerson and Childers.

SUMMARY OF THE INVENTION

A primary purpose of this invention is to modify tabular grain emulsion containing radiographic elements capable of quick processing so that non-uniformities in surface gloss are minimized.

In one aspect, this invention is directed to a medical diagnostic radiographic element capable of being processed in less than 45 seconds comprised of a support having front and back sides and, coated on the support, fully forehardened hydrophilic colloid layers including an imaging layer unit containing at least one radiation-sensitive tabular grain emulsion and a hydrophilic colloid layer overlying the imaging layer unit, total hydrophilic colloid coating coverages per side being limited to less than 40 mg/dm$^2$, wherein, to reduce gloss non-uniformities, the overlying hydrophilic colloid layer contains radiation-sensitive nontabular silver halide grains having projected areas accounting for from 0.5 to less than 15 percent of the total projected area of the overlying hydrophilic colloid layer and having a mean equivalent circular diameter ranging from greater than the thickness of the overlying hydrophilic colloid layer up to 1.6 times the thickness of the overlying hydrophilic colloid layer.

DESCRIPTION OF PREFERRED EMBODIMENTS

A typical medical diagnostic radiographic element exhibits the following structure:

F2 Front Overlying Hydrophilic Colloid Layer Unit

F1 Front Underlying Hydrophilic Colloid Layer Unit

S Support

SU Subbing Layer Unit

TF Transparent Film

SU Subbing Layer Unit

B1 Back Underlying Hydrophilic Colloid Layer Unit

B2 Back Overlying Hydrophilic Colloid Layer Unit

The radiographic element is comprised of a film support TF that can be a white reflective support, but is in the overwhelming majority of applications a transparent film to facilitate light box viewing of images. The transparent film support is often tinted blue, since this produces colder image tones and reduces visual fatigue. To facilitate coating hydrophilic colloid vehicles onto the transparent film subbing layer units SU are typically provided. The subbing layer unit contains a layer of a synthetic polymer that acts as an adhesive link between the transparent film and hydrophilic colloid. Over the polymer layer is coated a hydrophilic colloid second subbing layer that is hardened to such an extent that it does not ingest any significant amount of water during processing. Selections of materials are known that allow elimination of one or both subbing layers.

Underlying front hydrophilic colloid layer unit F1 is an imaging layer unit containing one or more radiation sensitive tabular grain silver halide emulsion layers.

In dual-coated formats the underlying back hydrophilic colloid layer unit B1 also contains one or more radiation sensitive tabular grain silver halide emulsion layers. In dual-coated formats F1 and B1 are in most instances identical and overall the radiographic elements are symmetrical—that is, corresponding coatings on the front and back sides of the support are identical. However, asymmetrical formats, usually involving different tabular grain emulsion selections for the front and back imaging layer units, are well known and advantageous for specific imaging applications.

It is possible to rely entirely on F1 for imaging. In this arrangement, referred to as a single-sided format, B1 commonly takes the form of a hydrophilic colloid layer containing one or more antihalation dyes. The function of B1 in this instances is (1) to reduce halation and (2) to offset the physical forces of the hydrophilic colloid coatings on the front side of the support that would otherwise case the film to curl. B1 is typically referred to as a pelloid, and it functions as an antihalation and anticurl layer.

In conventional radiographic elements the front and back overlying hydrophilic colloid layer units F2 and B2 are typically provided to offer physical protection to the underlying layer units during handling and processing. In addition to hydrophilic colloid F2 and B2 typically contain one or more of matting agents, antistatic agents, lubricants and other non-imaging addenda that function most efficiently at or near the surface of the element. It is sometimes convenient to divide each of F2 and B2 into a surface layer and an interlayer. The primary function of the interlayer is to separate the addenda in the surface layer from the imaging layer unit, but some addenda function equally well when coated in either the surface layer or the interlayer. In conventional radiographic elements, F2 and B2 are usually present, but neither is essential to imaging.

In the practice of the present invention it is contemplated to reduce non-uniformities in surface gloss by coating over an imaging layer unit containing at least one radiation-sensitive tabular grain emulsion a hydrophilic colloid layer that contains radiation sensitive nontabular silver halide grains (1) that account for from 0.5 (preferably at least 3) to less than 15 percent of monolayer coverage and (2) have a mean ECD greater than, but less than 1.5 times, the thickness of the hydrophilic colloid layer in which they are located.

Being nontabular, the grains are randomly oriented in the overlying hydrophilic colloid layer. By requiring that the grains have a mean ECD greater than the thickness of the layer in which they are contained, most of the non-tabular grains necessarily protrude above the surface of the hydrophilic colloid layer. Preferably the mean ECD of the grains is at least 1.1 times the thickness of the hydrophilic colloid layer in which they are contained. To increase the effect produced by the grains without using more silver than is required, the number of grains is increased by employing the minimum grain sizes consistent with achieving the minimum ECD requirements noted above. Thus, in the interest of efficiency, it is preferred to limit the mean ECD of the nontabular grains up to 1.6 times the thickness of the hydrophilic colloid layer in which they are contained. In manufacture hydrophilic colloid layer thicknesses, excluding the nontabular grains, can be accurately established by calculation. The thickness of the hydrophilic colloid layer can be confirmed by measurement of layer thicknesses at locations where the grains are absent. These measurements can be performed, for example, on photomicrographs of element cross-sections.

To be effective for gloss non-uniformity reduction only low levels of nontabular grains in the overlying hydrophilic colloid layer are required. Significant gloss reduction can be realized when the nontabular grains account for as little as 0.5 percent of the total projected area of the hydrophilic colloid layer. Thus, viewing a 1 $dm^2$ area of the radiographic film, as little as 0.005 $dm^2$ of this area can be occupied by the nontabular grains. Preferably the nontabular grains account for at least 3 percent of the total projected area of the hydrophilic colloid layer. Coating densities of the nontabular grains of up to 15 percent of the projected area of the hydrophilic colloid layer are contemplated. Preferably the nontabular grains are limited to 10 percent of the projected area of the hydrophilic colloid layer. In the low coating density ranges contemplated the nontabular grains are laterally separated, so that the nontabular grain projected areas equal for all practical purposes corresponding percentages of monolayer nontabular grain coating densities. This is quite different from imaging layer unit silver halide grain coating coverages, where the grains exhibit projected areas that are highly overlapped, or, stated another way, the summed projected areas of the grains without subtracting for overlaps far exceed 100 percent of monolayer grain coating coverage.

A primary purpose in choosing nontabular grain shapes is to assure random orientation. Tabular grains orient themselves during coating with major faces parallel to the coating plane, which greatly increases the amount of silver that must be employed per grain to achieve protrusions from the hydrophilic colloid layer in which they are contained. Additionally, tabular grains when employed to create protrusions introduce increased pressure sensitivity as compared to nontabular grains.

The nontabular grains can have any one or combination of {100}, {111} and even less common {110} crystal faces. In a preferred form the grains can be regular grains, such as cubes, octahedral, rhombic dodecahedra and tetradecahedra. The grains can be sufficiently ripened that edges and/or corners are rounded and, in an extreme, the grains can approach spherical forms. Although the nontabular grains can take regular or irregular forms, it is preferred that the grains be regular (that is, free of internal stacking faults, such as twin planes or screw dislocations). The size of the nontabular grains is determined by the thickness of the hydrophilic colloid layer in which they are contained, as noted above. However, most typically the nontabular grains have mean ECD's in the range of from 1.0 to 0.1 μm and, most typically, in the range of from 0.8 to 0.2 μm.

To be effective in reducing gloss non-uniformities the nontabular grains must be radiation-sensitive and developable during quick processing. The nontabular grains in the overlying hydrophilic colloid layer can be of any convenient conventional silver halide composition employed in radiographic elements capable of quick processing. For example, the silver halide compositions can be selected from among those set forth in the description below of the radiation-sensitive tabular grain emulsions employed in the imaging layer unit.

To be considered radiation sensitive for purposes of this invention the nontabular grains must be rendered developable by an exposure no greater than that which is just sufficient to produce a maximum density within the imaging layer unit. The coating density of the nontabular grains is so small that the contribution of developed nontabular grains to overall density is negligibly small. Since gloss non-uniformities are noticeable only in areas of maximum density, there is no advantage in the nontabular grains having sufficient sensitivity to be developed at lower exposure levels. It is, in fact, preferred that the nontabular grains require higher exposure levels to be rendered developable than the imaging layer unit, since this avoids adding to minimum density at the higher nontabular grain coating coverages. Nontabular grains almost always have imaging sensitivities at equal silver coverages that are much lower than those of tabular grain emulsions.

To render the nontabular grains radiation sensitive it is contemplated that they be chemically sensitized employing any conventional procedure for chemically sensitizing radiation sensitive grains, described below in connection with the imaging layer unit. If the tabular grain emulsion in the imaging layer unit is spectrally sensitized to capture photons outside the region of silver halide native sensitivity, then it is contemplated that the nontabular grains be also spectrally sensitized in the same wavelength region or regions of the spectrum.

The overlying hydrophilic colloid layer in which the nontabular grains are incorporated can be either the conventional surface overcoat or interlayer described above. When the nontabular grains are incorporated in an interlayer, it is contemplated that the overlying surface overcoat have a hydrophilic colloid coating coverage that does not exceed that of the interlayer. When this relationship exists the nontabular grain protrusions above the interlayer create a corresponding pattern of protrusions on the outer surface of the element.

It is possible to create a film with no observable gloss non-uniformities by including nontabular grains in only one overlying hydrophilic colloid layer even when the imaging layer unit is dual-coated, since only one surface of the film is viewed during diagnosis. However, it is generally most convenient to construct dual-coated films with overlying hydrophilic colloid layers containing radiation sensitive nontabular grains as described above overlying each image layer unit. This simplifies manufacture and use by eliminating potential misorientations of the film that could occur with nontabular grain coatings on only one side of a dual-coated element.

The imaging layer unit on one or both sides of the support contains one or more radiation sensitive tabular grain silver halide emulsion layers. Tabular grain silver halide emulsions contemplated for use in the practice of the invention can have any of the following silver halide compositions: silver chloride, silver bromide, silver iodobromide, silver chlorobromide, silver bromochloride, silver iodochloride, silver iodochlorobromide and silver iodobromochloride, where the mixed halides are named in order of ascending concentrations. Since it is recognized that the presence of iodide slows grain development, it is advantageous to choose emulsions that contain no iodide or only limited levels of iodide. Iodide concentrations of less than 4 mole percent, based on silver, are specifically preferred. Of the three photographic halides (chloride, bromide and iodide), silver chloride has the highest solubility and hence lends itself to achieving the highest rates of development. Silver bromide and silver iodobromide tabular grain emulsions containing no more than 2 mole percent iodide, based on silver are most commonly employed.

The tabular grain emulsions are preferably chosen so that tabular grains having thicknesses of less than 0.3 μm, most preferably less than 0.2 μm, in thickness account for greater than 70 percent and most preferably at least 90 percent of total grain projected area. Although the covering power of the tabular grains increases as their thickness is decreased, it is usually preferred to maintain average tabular grain thicknesses of at least about 0.1 μm to avoid undesirably warm image tones in the fully processed radiographic elements. It is generally recognized that tabular grain emulsions useful for imaging can have mean ECD's ranging up to about 10 μm, but in practice mean ECD's rarely exceed 5 μm and are typically less than 3 μm. The choice of mean grain sizes (ECD's) is dictated by balancing imaging speed and granularity (noise). Both speed and granularity are known to increase with increasing grain sizes. However, as taught by Kofron et al U.S. Pat. No. 4,439,520, spectrally sensitized tabular grain emulsions exhibit a superior speed-granularity relationship as compared to non-tabular grains coated at the same silver coverages. At the same mean ECD's greater than about 0.6 μm tabular grain emulsions are far superior to non-tabular grain emulsions in terms of granularity.

Conventional tabular grain emulsions are illustrated in *Research Disclosure*, Vol. 389, September 1996, Item 38957, I. Emulsion grains and their preparation, B. Grain morphology, paragraphs (1)–(3).

Conventional high (>50 mole %) chloride tabular grain emulsions are illustrated by the following citations, here incorporated by reference:

Wey et al U.S. Pat. No. 4,414,306;

Maskasky U.S. Pat. No. 4,400,463;

Maskasky U.S. Pat. No. 4,713,323;

Takada et al U.S. Pat. No. 4,783,398;

Nishikawa et al U.S. Pat. No. 4,952,491;

Ishiguro et al U.S. Pat. No. 4,983,508;

Tufano et al U.S. Pat. No. 4,804,621;

Maskasky U.S. Pat. No. 5,061,617;

Maskasky U.S. Pat. No. 5,178,997;

Maskasky and Chang U.S. Pat. No. 5,178,998;

Maskasky U.S. Pat. No. 5,183,732;

Maskasky U.S. Pat. No. 5,185,239;

Maskasky U.S. Pat. No. 5,217,858;

Chang et al U.S. Pat. No. 5,252,452;

Maskasky U.S. Pat. No. 5,264,337;

Maskasky U.S. Pat. No. 5,272,052;

Maskasky U.S. Pat. No. 5,275,930;

Maskasky U.S. Pat. No. 5,292,632;

Maskasky U.S. Pat. No. 5,298,387;

Maskasky U.S. Pat. No. 5,298,388;

House et al U.S. Pat. No. 5,320,938;

Maskasky U.S. Pat. No. 5,558,982;

Maskasky U.S. Pat. No. 5,607,828

Conventional high (>50 mole %) bromide tabular grain emulsions are illustrated by the following citations, here incorporated by reference:

Abbott et al U.S. Pat. No. 4,425,425;

Abbott et al U.S. Pat. No. 4,425,426;

Kofron et al U.S. Pat. No. 4,439,520;

Maskasky U.S. Pat. No. 4,713,320;

Ikeda et al U.S. Pat. No. 4,806,461;

Ohashi et al U.S. Pat. No. 4,835,095;

Makino et al U.S. Pat. No. 4,835,322;

Daubendiek et al U.S. Pat. No. 4,914,014;

Aida et al U.S. Pat. No. 4,962,015;

Tsaur et al U.S. Pat. No. 5,147,771;

Tsaur et al U.S. Pat. No. 5,147,772;

Tsaur et al U.S. Pat. No. 5,147,773;

Tsaur et al U.S. Pat. No. 5,174,774;

Tsaur et al U.S. Pat. No. 5,210,013;

Black et al U.S. Pat. No. 5,219,720;

Dickerson et al U.S. Pat. No. 5,252,443;

Delton U.S. Pat. No. 5,310,644;

Chaffee et al U.S. Pat. No. 5,358,840;

Delton U.S. Pat. No. 5,372,927;

Mignot et al U.S. Pat. No. 5,484,773; and

Maskasky U.S. Pat. No. 5,620,840.

The patents cited and incorporated by reference above also disclose conventional chemical and spectral sensitizations for the tabular grain emulsions. Chemical and spectral sensitizations of silver halide grains are generally disclosed in *Research Disclosure*, Item 38957, cited above, IV. Chemical sensitization and V. Spectral sensitization and desensitization, A. Sensitizing dyes. The chemical and spectral sensitization of tabular grain emulsions is more particularly taught in Kofron et al U.S. Pat. No. 4,429,520, here incorporated by reference. Antifoggants and stabilizers typically included in imaging emulsion layers are disclosed in Section VII. Antifoggants and stabilizers.

The coating coverage of silver in each imaging layer unit varies, depending upon whether the radiographic element has a single-sided or dual-coated format and depending upon the maximum density required for the particular imaging application. In all instances silver coating coverages in imaging layer units of less than 60 mg/dm$^2$ per side are contemplated to facilitate quick processing. For applications that permit maximum densities of less than 3, imaging layer unit silver coating coverages ranging down to about 15 mg/dm$^2$ are contemplated. Preferably dual-coated radiographic elements intended to provide maximum densities of at least 4.0 contain from 25 to 50 mg/dm$^2$ silver in each imaging layer unit.

To facilitate quick processing the hydrophilic colloid employed as vehicle in the emulsion and other processing solution permeable layers must be fully forehardened and must be limited to less than 40 gm/dm$^2$ per side, preferably no more than 35 mg/dm$^2$. Typically, minimum hydrophilic colloid coverages per side are at least 20 mg/dm$^2$, although still lower coating coverages should be possible for low silver coating coverage (therefore low maximum density) imaging applications. A summary of vehicles for photographic elements, including hydrophilic colloids, employed as peptizers and binders, and useful hardeners is contained in *Research Disclosure*, Item 38957, cited above, Section II. Preferred vehicles for the hydrophilic colloid layer units F1, F2, B1 and B2 are gelatin (e.g., alkali-treated gelatin or acid-treated gelatin) and gelatin derivatives (e.g., acetylated gelatin or phthalated gelatin). Although conventional hardeners can be used more or less interchangeably with little or no impact on performance, particularly preferred are the bis(vinylsulfonyl) class of hardeners, such as bis(vinylsulfonyl)alkylether or bis(vinylsulfonyl)alkane hardeners, where the alkyl moiety contains from 1 to 4 carbon atoms.

In the definition of "fully forehardened" above a swell test is recited that allows less than 300 percent increase in layer thickness. For quick processing it is preferred to replace the less than 300 percent limit with a limit of less than 200 percent and, optimally, less than 100 percent. A further description of the swell test and the manner in which swell can be reduced by increasing hardener concentrations is provided by Dickerson U.S. Pat. No. 4,414,304, the disclosure of which is here incorporated by reference.

Further specific selections of radiographic element features can take any convenient conventional form compatible with the descriptions provided above. For example, the transparent film support and the subbing layers that are typically provided on their major surfaces to improve the adhesion of hydrophilic colloid layers are disclosed in *Research Disclosure*, Item 38957, Section XV. Supports and in *Research Disclosure*, Vol. 184, August 1979, Item 18431, radiographic films/materials, Section XII. Film Supports.

The following sections of *Research Disclosure*, Item 18431 summarize additional features that are applicable to the radiographic elements of the invention:

II. Emulsion Stabilizers, Antifoggants and Antikinking Agents

III. Antistatic Agents/Layers

IV. Overcoat Layers

The following sections of *Research Disclosure*, Item 38957 summarize additional addenda that are most commonly coated in the overlying hydrophilic colloid layer units of radiographic elements and are specifically contemplated for optional inclusion in the radiographic elements of the invention:

IX. Coating physical property modifying addenda

A. Coating aids

B. Plasticizers and lubricants

C. Antistats

D. Matting Agents

In dual-coated formats the inclusion of crossover reducing dyes is preferred to obtain sharp images. Dickerson U.S. Pat.

No. 5,576,156, here incorporated by reference, discloses a preferred layer arrangement that permits quick processing and low crossover levels to be simultaneously realized. In this arrangement the imaging layer unit is divided into two separate emulsion layers with crossover reducing dye being located in the lower emulsion layer. The hydrophilic colloid layers are fully forehardened and limited to less than 35 mg/dm$^2$, preferably 19 to 33 mg/dm$^2$, per side. Although the ranges of Dickerson are fully applicable to this invention, the present invention allows the coating coverages of the hydrophilic colloid layers to be increased to 40 mg/dm$^2$, since the nontabular grains allow higher drying temperatures to be employed without objectionably increasing surface gloss non-uniformities.

EXAMPLES

The invention can be better appreciated by consideration in connection with the following specific embodiments. The letters c and e are appended to element numbers to differentiate control and example radiographic elements. All coating coverages are in mg/dm$^2$, except as otherwise indicated. Silver halide coating coverages are reported in terms of silver.

Example 1

A control radiographic element 1*c* was constructed as follows:

Transparent Film Support

A transparent film support having a thickness of 177.8 μm consisted of a conventional blue tinted poly(ethylene terephthalate) film coated first with a terpolymer latex of acrylonitrile, vinylidene chloride, and acid acrylic acid and then with a gelatin layer hardened so that it was processing solution impermeable.

Emulsion Layer

An emulsion layer was coated directly on the support at a layer thickness of 2.5 μm. The emulsion layer contained the following:

| Contents | Coverage |
|---|---|
| Ag | 19.4 |
| Gelatin | 22.7 |
| 4-Hydroxy-6-methyl-1,3,3a,7-tetraazaindene, sodium salt | 3.7 |
| 4,5-Dihydroxy-m-benzenesulfonic acid | 1.6 |
| Maleic acid hydrazide | 0.0079 |
| Sorbitol | 0.47 |
| Glycerin | 0.52 |
| Resorcinol | 0.79 |
| Bis(vinylsulfonylmethyl)ether | 0.70 |

The emulsion layer contained a tabular grain silver bromide emulsion. The grains had a mean ECD of 1.95 μm and the tabular grains had a mean thickness of 0.13 μm. Tabular grains accounted for greater than 50 percent of total grain projected area. The emulsion was sulfur and gold sensitized and spectrally sensitized to the green region of the spectrum.

Interlayer (IL)

Over the emulsion layer was coated an interlayer having a thickness of 0.4 μm and containing the following:

| Contents | Coverage |
|---|---|
| Gelatin | 3.5 |
| Disodium carboxymethyl casein | 0.82 |
| Polyacrylamide | 0.54 |
| Chrome potassium sulfate | 0.026 |
| Resorcinol | 0.060 |
| Nitron | 0.038 |
| 4-Hydroxy-6-methyl-1,3,3a,7-tetraazaindene, sodium salt | 0.49 |
| Nonylphenoxypolyglycerol | 0.62 |
| Poly(acrylamide-co-1,1-dimethyl-ethylacrylamide) (20:80) sodium salt | 0.12 |

Surface Overcoat (SOC)

Over the interlayer was coated a surface overcoat having a thickness of 0.4 μm and containing the following:

| Contents | Coverage |
|---|---|
| Gelatin | 3.5 |
| Nonylphenoxypolyglycerol | 1.8 |
| Colloidal silica | 1.1 |
| Disodium carboxymethyl casein | 0.73 |
| Matte beads (4 μm) | 0.57 |
| Polyacrylamide | 0.54 |
| Silicone polyethylene glycol | 0.46 |
| Lithium trifluoromethane sulfonate | 0.45 |
| Perfluoroalkyl substituted polyethylene glycol | 0.24 |
| Resorcinol | 0.059 |
| Chrome potassium sulfate | 0.026 |

An example radiographic element 1*e* was constructed identically to radiographic element 1*c*, except that a silver bromide cubic grain emulsion, which was sulfur and gold sensitized and spectrally sensitized to the green like the tabular grain emulsion, having a grain mean ECD of 0.51 μm was added to the SOC. Thus, the mean ECD of the nontabular grains was 1.27 times the thickness of the SOC. The coating coverage of cubic grains was 1.6, based on silver, providing a cubic grain projected area of 8.6 percent of the total SOC projected area.

The films were then given an overall exposure with white light sufficient to drive development to maximum density.

The exposed elements were processed using a Kodak X-Omat RA 5000 processor set for the following processing cycle:

| | |
|---|---|
| Development | 11 seconds at 40° C. |
| Fixing | 9 seconds at 30° C. |
| Washing | 8 seconds at 14° C. |
| Drying | 12 seconds at 54° C. |

The following developer and fixer were employed, components are expressed in g/L, except as indicated:

| Developer (D1) | |
|---|---|
| Hydroquinone | 30 |
| 4-Hydroxymethyl-4-methyl-1-phenyl 3-pyrazolidinone | 1.5 |
| Potassium hydroxide | 21.00 |
| 5-Methylbenzotriazole | 0.06 |

-continued

| | |
|---|---|
| Sodium bicarbonate | 7.5 |
| Potassium sulfite | 44.2 |
| Sodium metabisulfite | 12.6 |
| Sodium bromide | 35.0 |
| Glutaraldehyde | 4.9 |
| Water to 1 liter | |
| pH | 10 |
| Fixer (F1) | |
| Ammonium thiosulfate, 60% | 260.0 |
| Sodium bisulfite | 180.6 |
| Boric acid | 25.3 |
| Acetic acid | 10 |
| Aluminum sulfate | 8 |
| Water to 1 liter | |
| pH 3.9 to 4.5 | |

The developer and fixer are normally used for 55 second and longer processing cycles, but were employed here to create conditions that would emphasize gloss non-uniformities. The glutaraldehyde is a standard component for developers employing longer processing cycles, which accommodate radiographic elements that have not been fully forehardened, but the glutaraldehyde had little, if any effect on the fully forehardened elements that were processed.

Gloss Measurement

The radiographic elements 1*c* and 1*e* were examined using a gloss scanner as follows: Gloss of the films was measured at 5 mm intervals using a scan head. The scan head was comprised of an illumination source, illumination beam focusing optics, reflected illumination optics, a reflected light collector, and a photocell. The illumination source was a 20 to 30 milliwatt light emitting diode having a wavelength of 670 nm. The illumination light was collimated by passing through the illumination beam focusing optics to produce a beam 1 mm in diameter. The illumination focusing optics was mounted approximately 6.5 mm above the film surface to direct the beam at the film at an inclination angle of 20° , measured from a line normal to the film surface. The reflected beam was received by the collector and photocell, and the electrical signal from the photocell was converted to a gloss value using a scale calibrated to a Hunter™ gloss-meter.

From this data the standard deviation (σ) of the gloss value was calculated. The standard deviations measured for radiographic elements 1*c* and 1*e* are reported in Table I.

TABLE I

| Element | Standard Deviation |
|---|---|
| 1c | 1.52 |
| 1e | 0.41 |

From Table I it is apparent that addition of the nontabular silver bromide grains to the SOC resulted in a 73 percent reduction in the gloss standard deviation observed in the absence of the nontabular silver bromide grains.

Example 2

A series of radiographic elements were constructed similarly to those of Example 1, except that different coating coverages of cubic silver bromide grains of differing mean ECD's were compared, including a control lacking cubic grains, as set out in Table II.

In this series of elements the emulsion layer differed from that of Example 1, being as follows:

Emulsion Layer

An emulsion layer was coated directly on the support at a layer thickness of 3.5 μm. The emulsion layer contained the following:

| Contents | Coverage |
|---|---|
| Ag | 22.5 |
| Gelatin | 31.2 |
| 4-Hydroxy-6-methyl-1,3,3a,7-tetraazaindene, sodium salt | 4.3 |
| 4,5-Dihydroxy-m-benzenesulfonic acid | 1.8 |
| Maleic acid hydrazide | 0.0093 |
| Sorbitol | 0.55 |
| Glycerin | 0.55 |
| Resorcinol | 0.92 |
| Bis(vinylsulfonylmethyl)ether | 0.90 |

The same tabular grain emulsion was employed as in Example 1, and the chemical and spectral sensitizations of both the tabular grain emulsion and the cubic grains were also the same as in Example 1.

TABLE II

| | | Nontabular Grains | | |
|---|---|---|---|---|
| Element | Gloss σ | mean ECD (μ/X*) | Coverage mg/dm$^2$ | Projected Area (%) |
| Ac | 0.91 | — | 0 | 0 |
| Bc | 0.62 | 0.97/2.4 | 0.54 | 1.7 |
| Cc | 0.41 | 0.97/2.4 | 1.1 | 3.3 |
| Dc | 0.29 | 0.97/2.4 | 1.6 | 4.9 |
| Ee | 0.51 | 0.64/1.6 | 0.54 | 2.5 |
| Fe | 0.25 | 0.64/1.6 | 1.1 | 4.9 |
| Ge | 0.21 | 0.64/1.6 | 1.6 | 7.4 |
| He | 0.37 | 0.53/1.35 | 0.54 | 3.0 |
| Ie | 0.25 | 0.53/1.35 | 1.1 | 6.1 |
| Je | 0.15 | 0.53/1.35 | 1.6 | 9.1 |
| Kc | 0.52 | 0.38/0.95 | 0.54 | 3.8 |
| Lc | 0.45 | 0.38/0.95 | 1.1 | 7.6 |
| Mc | 0.28 | 0.38/0.95 | 1.6 | 11.5 |

*Times hydrophilic colloid layer thickness

The elements A through M were exposed, processed and examined for gloss characteristics as described in Example 1, except that the drying temperature was increased to 60° C.

The standard deviation (σ) of gloss is summarized in Table II. In all instances the addition of nontabular grains to the SOC reduced gloss non-uniformity. However, when the mean ECD of the grains was selected to be greater than and up to 1.6 times the thickness of the SOC, superior levels of gloss uniformity, reported in terms of lower σ values, were obtained. This demonstrated that selecting nontabular grains for inclusion in an overlying hydrophilic colloid as described offers gloss uniformity advantages that have not been previously realized in quick processed films containing tabular grain emulsions. Gloss standard deviation was significantly improved when projected areas of the nontabular grains were at least 3 percent of total projected area.

The invention has been described in detail with particular reference to preferred embodiments thereof, but it will be understood that variations and modifications can be effected within the spirit and scope of the invention.

What is claimed is:

1. A medical diagnostic radiographic element capable of being processed in less than 45 seconds comprised of a support having front and back sides and, coated on the support, fully forehardened hydrophilic colloid layers including an imaging layer unit containing at least one radiation-sensitive tabular grain emulsion and a hydrophilic colloid layer overlying the imaging layer unit, total hydrophilic colloid coating coverages per side being limited to less than 40 mg/dm$^2$, WHEREIN, to reduce gloss non-uniformities, the overlying hydrophilic colloid layer contains radiation-sensitive nontabular silver halide grains having projected areas accounting for from 0.5 to less than 15 percent of the total projected area of the overlying hydrophilic colloid layer and having a mean equivalent circular diameter ranging from greater than the thickness of the overlying hydrophilic colloid layer up to 1.6 times the thickness of the overlying hydrophilic colloid layer.

2. A medical diagnostic radiographic element according to claim 1 wherein the radiation-sensitive nontabular silver halide grains have projected areas accounting for from 3.0 to less than 10 percent of the total projected area of the overlying hydrophilic colloid layer.

3. A medical diagnostic radiographic element according to claim 1 wherein imaging layer units are coated on the front and back sides of the support, a hydrophilic colloid layer overlies each of the imaging layer units and each overlying layer unit contains radiation-sensitive nontabular silver halide grains having projected areas accounting for from 0.5 to less than 10 percent of the total projected area of the overlying hydrophilic colloid layer and having a mean equivalent circular diameter ranging from greater than the thickness of the overlying hydrophilic colloid layer up to 1.6 times the thickness of the overlying hydrophilic colloid layer.

4. A medical diagnostic radiographic element according to claim 1 wherein the nontabular grains have mean equivalent circular diameters in the range of from 0.1 to 1.0 micrometers.

5. A medical diagnostic radiographic element according to claim 4 wherein the nontabular grains have mean equivalent circular diameters in the range of from 0.2 to 0.9 micrometers.

6. A medical diagnostic radiographic element according to claim 1 wherein the tabular grain emulsion and the nontabular grains contain less than 4 mole percent iodide, based on silver.

7. A medical diagnostic radiographic element according to claim 6 wherein the nontabular grains are silver bromide grains.

8. A medical diagnostic radiographic element according to claim 1 wherein the nontabular grains are regular grains.

* * * * *